US005382182A

United States Patent [19]

Shen et al.

[11] Patent Number: 5,382,182

[45] Date of Patent: Jan. 17, 1995

[54] SPECIAL PURPOSE MODULAR CONNECTOR PLUG

[75] Inventors: David W. Shen, Cupertino; Robert A. Howard, Mountain View; Robert A. Riccomini, Saratoga; Steven J. Young, Milpitas, all of Calif.; Robert E. L. Cox, Croissy-sur-Seine; Philippe Le Bars, Elancourt, both of France; Keiichi Tsukinari, Mission Viejo, Calif.

[73] Assignee: Apple Computer, Inc., Cupertino, Calif.

[21] Appl. No.: 68,868

[22] Filed: May 28, 1993

[51] Int. Cl.[6] ..... H01R 23/02

[52] U.S. Cl. ..... 439/676; 439/425; 439/620

[58] Field of Search ..... 439/676, 660, 692–697, 439/425, 620

[56] References Cited

U.S. PATENT DOCUMENTS

| | | | |
|---|---|---|---|
| 3,963,300 | 6/1976 | Patton et al. | 439/676 |
| 4,103,985 | 8/1978 | Krolak et al. | 439/676 |
| 4,225,209 | 9/1980 | Hughes | 439/676 |
| 4,290,664 | 9/1981 | Davis et al. | 439/676 |
| 4,362,905 | 12/1982 | Ismail | 439/676 |
| 4,493,951 | 1/1985 | Sandersson et al. | 439/676 |
| 4,655,522 | 4/1987 | Beck, Jr. et al. | 439/676 |
| 4,679,879 | 7/1987 | Triner et al. | 439/425 |
| 4,767,355 | 8/1988 | Phillipson et al. | 439/425 |

*Primary Examiner*—Steven C. Bishop

*Attorney, Agent, or Firm*—Greg T. Sueoka

[57] ABSTRACT

A special purpose modular connector comprising a generally rectangular housing having a central body portion and two extending side arm portions. A plurality of electrical contacts are disposed within the body and arm portions. Slots at a front end of each portion of the housing expose a terminal end of each electrical contact. Openings in the rear portions of the housing allow connection of cables or other types of component wiring to the contacts. A locking tab is formed at the underside of the housing and functions to align and securely connect the special purpose modular connector with a correspondingly modified receptacle.

24 Claims, 2 Drawing Sheets

SPECIAL PURPOSE MODULAR CONNECTOR PLUG

CROSS-REFERENCE TO RELATED APPLICATIONS

This application relates to U.S. patent application Ser. No. 08/073,724 entitled "Special Purpose Modular Receptacle Jack," filed on Jun. 9, 1993.

BACKGROUND OF THE INVENTION

1. Field of the Invention

The present invention relates generally to the physical design of an electrical connector, and more particularly, to a communications connector providing at least two separately accessible sets of contacts, and being designed to selectively connect to a corresponding receptacle.

2. Description of the Background Art

Telecommunications equipment has benefited from the design of electrical plugs and jacks that provide easy connect/disconnect capability between electrical circuits within the telecommunications equipment and for local network wiring. Such plugs and jacks are particularly popular in association with telephone sets where they were first used. Modular plugs and jacks have been so well received that their specifications are standardized and can be found in Subpart F of the FCC-Part 68.500 Registration Rules.

Modular plugs provide a convenient means for connecting and disconnecting telephone equipment, telecommunications equipment, and computer-related equipment. Common modular connectors conventionally comprise between two and eight contacts embedded within a generally rectangular plastic housing. The housing defines slots to expose a terminal portion of each contact. The housing also includes an opening for connecting wiring or cabling to the contacts, and a squeeze tab for securely fastening the modular plug to a corresponding jack.

The design standardization of common modular plugs allows equipment utilizing such plugs to be interchangeably connected to a single receptacle. This feature is beneficial with respect to telephone plugs and jacks, in that it allows phone units to be moved from room to room or from house to house without requiring modification of the corresponding receptacles. However, manufacturers of some types of equipment such as computers may wish to have their equipment selectively connected to a predetermined receptacle. Equipment having a special purpose modular connector can only be plugged into a corresponding special purpose modular receptacle.

It is also desirable to provide a plug having an increased number of contacts which would allow additional electrical components to be connected through a single modular plug into a single modular jack.

SUMMARY OF THE INVENTION

The present invention is a modular electrical connector or plug, providing at least two separately accessible sets of contacts disposed within a housing having a special design such that the modular electrical connector/plug can be selectively connected to a receptacle/jack having a corresponding design. The special purpose modular connector/plug offers additional sets of contacts allowing more than one electrical component to be wired using a single plug.

The modular connector/plug of the present invention comprises a generally rectangular housing having a central body portion and two arm members that extend forward. A first set of electrical contacts are disposed within the body portion and a second and third set are disposed within the arm members. Slots at a front end of the body portion and arm members of the housing expose a terminal end of each electrical contact. Openings in the rear portions of the housing allow for the connection of cables or other types of component wiring to the contacts. A locking tab is formed on the underside of the housing, and functions to align and securely connect the special purpose modular connector with a correspondingly modified receptacle/jack.

DETAILED DESCRIPTION OF THE PREFERRED EMBODIMENTS

Figure 1:
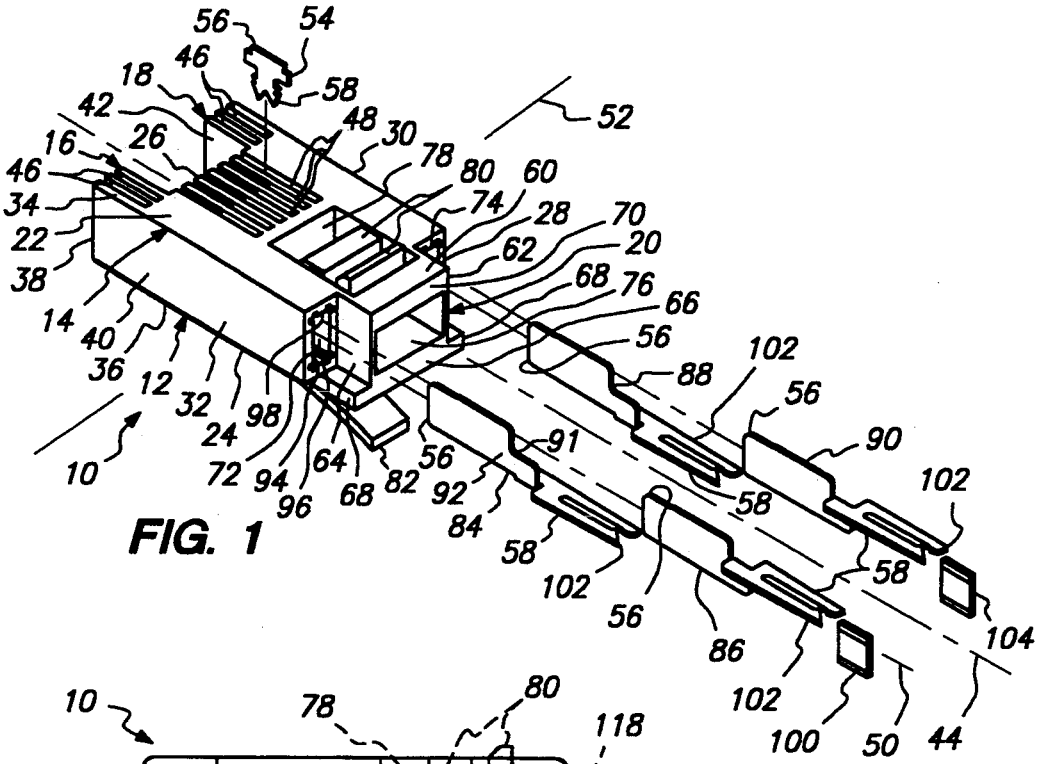
FIG. 1 is an exploded perspective view of a first and preferred embodiment of a special purpose modular connector constructed in accordance with the present invention.

FIG. 1 shows an exploded perspective view of a preferred embodiment of a special purpose modular connector plug 10 constructed in accordance with the present invention. The plug 10 comprises a molded housing 12 of clear polycarbonate having a central body 14 with two forward extending arm members 16, 18 and a rear extending tail member 20 formed therefrom. The generally rectangular central body 14 has a top side 22, a bottom side 24, a front side 26, a rear side 28, a right side 30 and a left side 32. Each forward extending arm member 16, 18 forms an extension of the central body 14. The left arm member 16 is an extension of the bottom and left sides 24, 32, respectively, of the central body 14, and the right arm member 18 is an extension of the bottom and right sides 24, 30, respectively, of the central body 14. Each rectangularly-shaped arm member 16, 18 includes a top 34, a bottom 36, a front 38, an outer side 40 and an inner side 42. As an integral extension of the central body 14, each arm member 16, 18, is disposed in parallel relationship with the longitudinal axis 44 of the central body 14, such that the top 34 of each arm member 16, 18 is flush with the top side 22 of the central body 14.

Vertical slots 46, 48 are formed in the upper front part of the arm members 16, 18 and the central body 14, respectively. The slots 46 of the arm members 16, 18 begin at their front 38 and are formed parallel to the longitudinal axis 50 of the arm members 16, 18 to a point co-planar with the central body's front side 26. Likewise, the slots 48 of the central body 14 begin at the central body's front side 26, are formed along the central body's top side 22 parallel with its longitudinal axis 44 and proximate the midline 52 of the central body 14.

The slot 48 exposes a phosphor bronze contact 54 that is embedded within the housing 12. Each slot 46 exposes a phosphor bronze contact 84, 86, 88 and 90, that is embedded with the respective arm member 16, 18 of the housing 12. An exemplary phosphor bronze contact 54 is shown above the central body 14 with a dashed correlation line indicating the placement of the contact 54 within the slot 48. Each contact 54 has a terminal end 56 and an attachment end 58. Although only one contact 54 is depicted, it is meant as a representation of the plurality of contacts 54 contained within the housing 12 and not as a limitation on the number of contacts. Moreover, the contact 54 may be constructed of other conductive material such as copper.

The rear side 28 of the central body 14 includes a centrally disposed tail member 20 that extends from the rear side 28 and parallel with the longitudinal axis 44 of the central body 14. The tail member 20 includes a top surface 60, a right surface 62, a left surface 64, a base 66 having flanges 68 formed thereon, and a rear surface 70. As an integral extension of the central body 14, the tail member's top surface 60 is flush with the top side 22 of the central body 14. The width between the tail member's right and left surfaces 62, 64, as well as the width of its flanged base 66 are preferably less than the width of the central body 14. The height of the tail member 20 is greater than that of the central body 14, and thus, the tail member's base 66 is partially disposed below the central body's bottom side 24. The base 66 extends from the tail member's rear surface 70 to a position proximate the central body's front side 26.

The central body's rear side 28 includes two openings 72, 74 formed on opposite sides of the tail 20. The openings 72, 74 allow access to the attachment ends 458, 658, 858, 958 of the contacts 84, 86, 88, 90 disposed within the arm members 16, 18. Similarly, the tail member 20 includes a large opening 76 in its rear surface 70, providing access to the attachment ends 58 of the contacts 54 disposed within the central body 14. A first cavity 78 including stress relieving members 80 is disposed rear of the slots 48 of the cervial body 14 and provides a means for securing a cable 112 within the plug 10 as will be further described in FIG. 2. A locking tab 82 for securely connecting the plug 10 with a mating female jack (not shown), is formed in the central body's bottom side 24.

Standard modular electrical connector plugs comprise a rectangular body that houses between two and eight contacts and provides an opening for connecting wiring for an electrical component. The present invention provides more than the standard number of contacts by incorporating arm members 16, 18 that house additional contacts to which additional electrical components may be wired. In the preferred embodiment, each forward extending arm member 16, 18 houses two additional contacts 84, 86, 88 and 90, although fewer or greater numbers of additional contacts are anticipated. As illustrated in FIG. 1, a first additional contact 84 is preferably made from a flat, rectangular piece of phosphor bronze. The contact 84 has a terminal end 456 and an attachment end 458. The contact 84 includes a notch 91 at the midpoint 92 of the contact 84 and includes a right angle bend at the notch 91 location such that the terminal end 456 of the contact 84 is disposed at a right angle to the attachment end 458. The second 86, third 88, and fourth 90 additional contacts are similarly constructed.

The additional contacts 84, 86, 88 and 90 are shown in FIG. 1 with dashed correlation lines indicating their placement within the arm members 16, 18. The additional contacts 84, 86, 88 and 90 are inserted through the openings 72 and 74 in the central body's rear side 28 with their terminal ends 456, 656, 856, 956 proceeding first. In contrast, contact 154 is placed within the housing 12 by being inserted down through the slot 48 from the topside of the housing 12.

The first and second additional contacts 84 and 86 are positioned on opposite sides of opening 72 such that the terminal end 456 of the first contact 84 resides within the left arm member 16 adjacent the inner surface 94 of the left arm member's outer side 40. The terminal end 656 of the second additional contact 86 resides adjacent the first additional contact 84, disposed parallel thereto. The attachment end 458 of the first additional contact 84 is disposed adjacent the inner surface 96 of the central body's bottom side 24 while the attachment end 658 of the second additional contact 86 is disposed opposite thereto, adjacent the inner surface 98 of the central body's top side 22. The third and fourth additional contacts 88, 90 are disposed within the right arm member 18 in a like manner as the first and second additional contacts 84, 86. A first resistor 100 is engagingly disposed between the prongs 102 of the attachment ends 458, 658 of the first and second additional contacts 84 and 86, and a second resistor 104 is likewise disposed between the prongs 102 of the attachment ends 858, 958 of the third and fourth additional contacts 88 and 90. The additional contacts 84, 86, 88 and 90 function in pairs, but may also function in any combination of contacts based on the actual number of contacts and their application.

Figure 2:
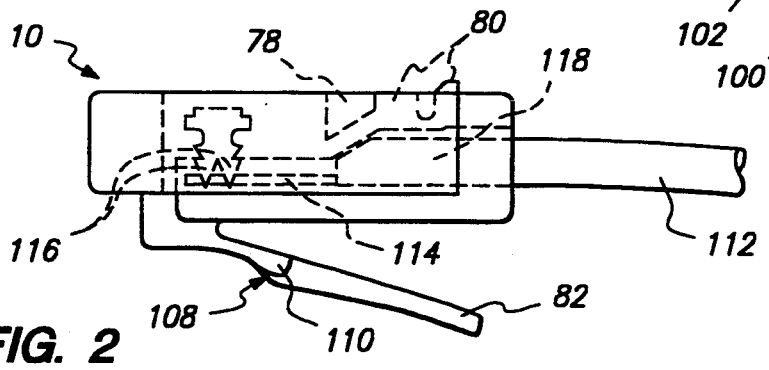
FIG. 2 is a side view of the connector of FIG. 1 illustrating the shape and placement of the locking tab and further illustrating the disposition of a contact and concomitant cabling within the housing.

FIG. 2 is a side view of the plug of FIG. 1 illustrating the length and disposition of the flanged base 66 of the tail member 20 formed integrally with the bottom side 24 of the central body 14 from the tail's rear surface 70 to a position proximate the central body's front side 26.

A locking tab 82 integral with the housing 12 is formed from the lower front part of the central body 14 and diverges therefrom proximate the central body's front side 26. The width of the tab 82 narrows at a joint 108 and the length of the tab 82 extends beyond the joint 108 the full length of the housing 12. Shoulders 110 formed at the joint 108 secure the attachment of the plug 10 in a female receptacle. To install the plug 10 within a mating female receptacle, the tab 82 and the central body 14 are squeezed together to provide a clearance for inserting the plug 10 into a receptacle (not shown). After the plug 10 is inserted, the tab 82 is released and the shoulders 110 engage a stop wall within the receptacle. The interference between the shoulders 110 of the plug and the stop wall of the receptacle prevents the plug from disengaging from the receptacle until and unless the tab and the body are again compressed together to create the necessary clearance.

An electrical cable 112 is shown attached to the contacts 54 through the opening 76 of the tail member 20. Each wire 114 within the cable 112 is conductively attached to the attachment end 58 of a contact 54 within the plug's housing 12. The attachment end 58 is comprised of a pair of legs 116 which bear down on an uninsulated section of the wire 114 at the end of the cable 112. The cavity 78 and stress relieving members 80 are shown compressing insulation covering 118 at the end of the cable 112. The stress relieving members 80 prohibit the cable 112 from detaching from the plug 10 in the event plug 10 and cable 112 are pulled in opposite directions. Similarly, additional cables (not shown) are inserted through the openings 72, 74 to electrically couple wires to the attachment ends 458, 658, 858, 958 of the additional contacts 84, 86, 88, 90, respectively. The prongs 102 make electrical contact with respective wires in the same manner that the wires of cable 112 make electrical contact with the legs 116 of contact 54. In particular and as best shown in FIG. 1, protrusions on the prongs 102 of the additional contacts 84, 86, 88, 90 narrow the distance between the prongs 102 thereby pinching through the insulation of any wire to electrically couple the wire to the attachment ends 458, 658, 858, 958 of the additional contacts 84, 86, 88, 90 as a wire is inserted between the prongs 102 in a conventional manner.

In operation, the cables and connector assembly 10 electrically connect components such as for a computer to a wiring network via an electrical receptacle. When the plug 10 is inserted into a special purpose receptacle that has been modified to accept the arm members 16, 18 of the plug 10, the exposed terminal ends 56, 456, 656, 856, 956 of the contacts 54, 84, 86, 88 and 90, within the slots 48, touch a corresponding conductive terminal end of a contact within the receptacle. Electrical signals are sent through the cables and plug assembly 10 to the receptacle and network wiring assembly, or vice versa.

Figure 3:
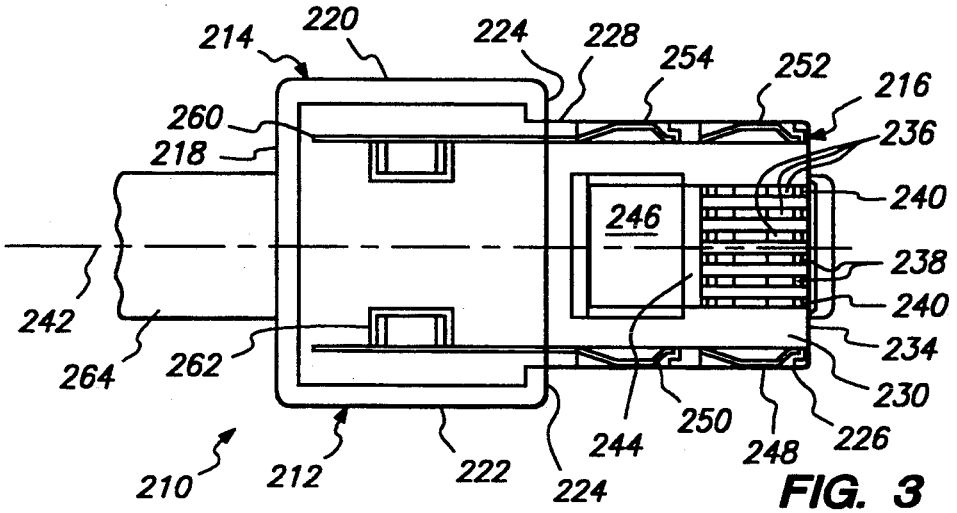
FIG. 3 is a top plan view of a second embodiment of a special purpose modular connector of the present invention, where two pairs of additional contacts are exposed at opposite sides of a generally rectangular housing and two resistors reside within a larger rear portion of the housing.
Figure 4:
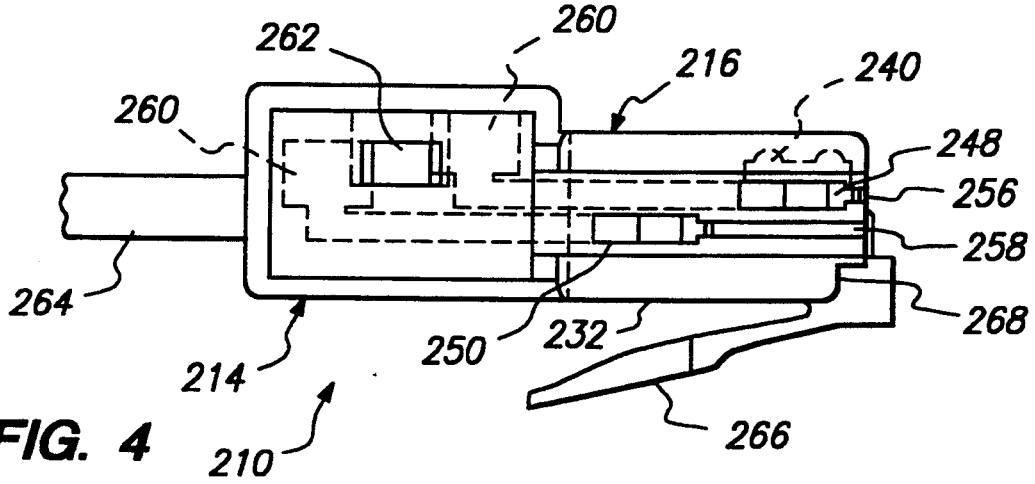
FIG. 4 is a side view of the connector illustrated in FIG. 3, showing the offset positioning of the exposed side contacts, and also showing the placement of the resistors and the locking tab.

FIGS. 3 and 4 illustrate a second embodiment 210 of the special purpose modular connector plug constructed in accordance with the present invention. The housing 212 is comprised of a generally square rear portion 214 and a smaller, generally rectangular front portion 216. The rear portion 214 includes a rear side 218, a left side 220, a right side 222 and a pair of shoulders 224. The front portion 216 extends from, and is integral with, the shoulders 224 of the rear portion 214. The front portion 216 includes a right side 226, a left side 228, a top side 230, a bottom side 232 and a front side 234. The front and top sides 234, 230 of the front portion 216 include vertical slots 236 through which the terminal ends 238 of a first set of contacts 240 are exposed. The slots 236 are formed in parallel relationship with a longitudinal axis 242 of the housing 212 and extend from the front side 234 to a point proximate the midpoint 244 of the front portion 216. A stress relieving cavity 246 is formed at the top side 230 of the front portion, aft of the slots 236.

Additional electrical contacts 248, 250, 252 and 254 are disposed within the housing 212 parallel with the first set of contacts 240. A first set of additional contacts 248 and 250 are disposed on the right side 226 of the front portion 216, in parallel positions yet staggered from each other, with the upper contact 248 being disposed closer to the front side 234 than the lower contact 250. A terminal end of each contact 248, 250 is exposed through a channel 256, 258 formed in the right side 226 of the front portion 216. A first short channel 256 is formed along the forward portion's right side 226 from the front side 234 to the terminal end of the upper contact 248 in parallel alignment with the longitudinal axis 242 of the housing 212. A second elongated channel 258 is formed along the same side from the front side 234 to the terminal end of the lower contact 250, in parallel alignment with the longitudinal axis 242 of the housing 212. The attachment ends 260 of the additional contacts 248 and 250 are disposed within the rear portion 214 where they are connected to a resistor 262 disposed centrally therewithin. An apparatus cable 264 is shown attached to the rear side 218 of the rear portion 214. As shown in FIGS. 3 and 4, the rear portion 214 defines a cavity providing an area for accessing both the first set of contacts 240 and the additional contacts 248, 250, 252 and 254 for coupling to the cable 264. In contrast to the preferred embodiment, the second embodiment may be used with a single cable for coupling both the first set of contacts 240 and the additional contacts 248, 250, 252 and 254. A locking tab 266, similar in form and function to that shown in FIG. 2, is formed from the lower front part 268 of the front portion 216 and diverges therefrom.

Figure 5:
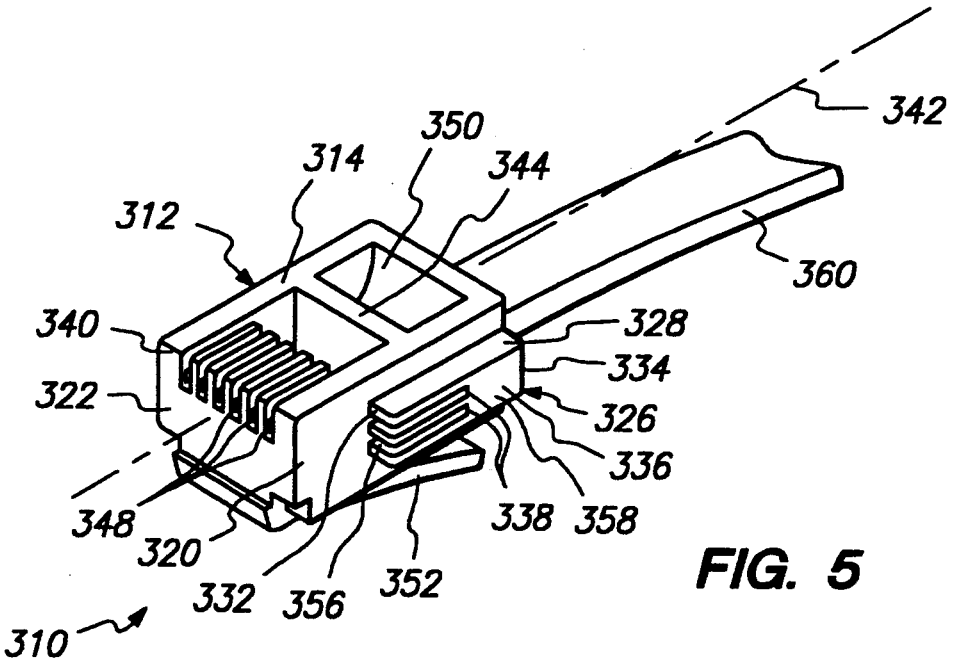
FIG. 5 is a top perspective view of a third embodiment of the special purpose modular connector of the present invention, showing a modified plug having a first pair of additional contacts disposed within an arm formed at one side of the plug.
Figure 6:
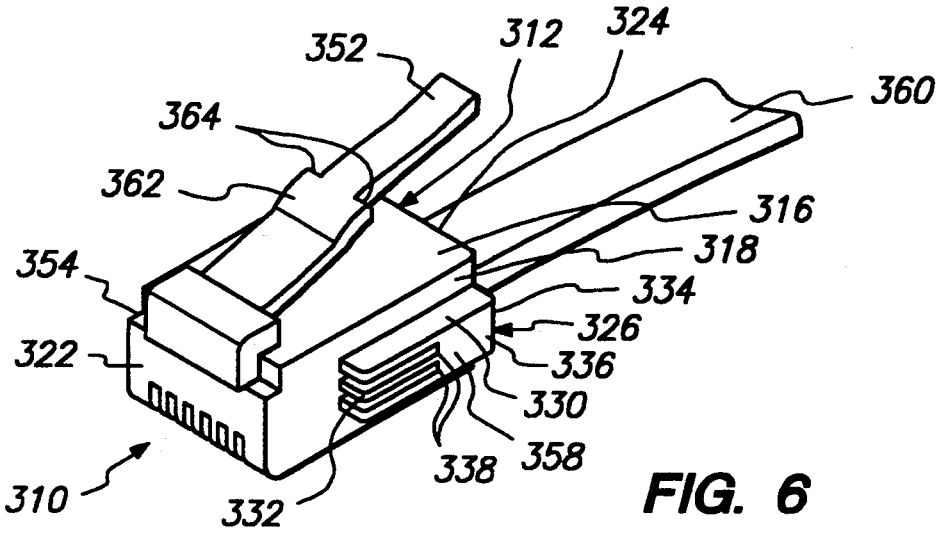
FIG. 6 is a bottom perspective view of the connector of FIG. 5, illustrating the disposition of a second pair of additional contacts and a locking tab.

FIGS. 5 and 6 illustrate a third embodiment 310 of the special purpose modular connector plug built in accordance with the present invention. A generally rectangular body 312 includes a top side 314, a bottom side 316, a right side 318, a left side 320, a front side 322 and a rear side 324. The right and left sides 318, 320 each include a small elongated rectangular arm 326 attached thereto. Each arm 326 has a top 328, a bottom 330, a front 332, a rear 334 and an outer side 336.

In FIG. 5, the body 312 is shown to include a plurality of slots 337 formed in the upper front portion 340. Each slot 337 begins at the front side 322 of the body 312, is formed in parallel with the longitudinal axis 342 of the body 312 along the top side 314 and ends at a point proximate the midsection 344 of the body 312. Each slot 337 exposes the terminal end of a phosphor bronze contact 348 disposed within the body 312. A stress relieving cavity 350 is formed in the top side 314 of the body 312, aft of the slots 337.

A first elongated rectangular side arm 326 is attached to the left side 320 of the body 312, disposed in parallel relationship with the body's longitudinal axis 342. The left side arm 326 includes two slots 338 formed at the front 332 therein, beginning at the front 332 and being formed along the outer side 336 to a point proximate the midsection 358 thereof. Each slot 338 exposes a phosphor bronze contact 356 embedded therewithin. An additional cable is attached to the contact 356 through an opening in the body's rear side 324 like that shown in FIG. 2.

FIG. 6 further illustrates how a locking tab 352, similar to those previously described, is formed from the lower front part 354 of the body 312. FIG. 6 clearly illustrates how the width of the tab 352 narrows at a joint 362 and the length of the tab 352 extends beyond the joint 362 the full length of the body 312. The shoulders 364 formed at the joint 362 secure the attachment of the plug 310 to a female receptacle mated therewith as previously described in the discussion of FIG. 2.

The plug 310 of this embodiment can only be mated to a receptacle that has been specially made or modified to include side channels that engage the side arms 326 of the plug 310, and further modified to provide mating contacts positioned within the side channels corresponding to the exposed portions of the additional contacts 356 in each side arm 326.

Unlike the arm members 16, 18 of FIG. 1, the side arms 326 of this embodiment are recessed from the plane of the body's front side instead of forwardly extending, and the slots 338 in this embodiment are horizontal unlike the side slots 46 of the preferred embodiment which are vertical. In contrast to the embodiment illustrated in FIGS. 4 and 5, the side arms 326 of this embodiment are not flush with the sides of the central body portion, but extend outwardly therefrom. Although the contacts 356 are positioned in parallel, they are not staggered as are those in FIG. 4, but instead are vertically aligned at the front end of the side arm 326.

While the present invention has been described with reference to certain preferred embodiments, those skilled in the art will recognize that various modifications may be provided. For example, modifications might include, but would not be limited to, an embodiment containing only one arm member, additional or fewer slots on either the central body or the arm members, or arm members containing an unequal number of slots. These and other variations upon and modifications to the preferred embodiment are provided for by the present invention which is limited only by the following claims.

We claim:

1. A special purpose modular connector plug for coupling with a female receptacle comprising:

a housing having a central body with a first end, a second end, a first side, a second side, a top side and a bottom side, and a first extending arm member;

a first set of contacts, each contact having a first end and a second end, the first ends of the first set of contacts disposed along a first plane proximate the first end of the housing, the second ends of the first set of contacts proximate the second end of the housing and being accessible for the transmission of electronic signals over the first set of contacts;

a second set of contacts, each contact having a first end and a second end, the first ends of the second set of contacts disposed along a second plane that is not co-planar with the first plane and disposed within the first extending arm member, the second ends of the second set of contacts being accessible for the transmission of electronic signals over the second set of contacts; and means for removably fastening the connector in mating disposition with the female receptacle.

2. A special purpose modular connector plug as recited in claim 1, wherein the housing defines a plurality of apertures proximate the first ends of the first set of contacts, the housing aligned with the first set of contacts such that portions of the first set of contacts are exposed through th eapertures.

3. The special purpose modular connector plug as recited in claim 1, wherein the second plane is parallel to the first plane.

4. The special purpose modular connector plug as recited in claim 1, wherein the housing defines a plurality of apertures in alignment with the second set of contacts such that portions of the second set of contacts are exposed through the apertures.

5. The special purpose modular connector plug as recited in claim 1, wherein the housing defines an aperture proximate the second ends of the first set of contacts.

6. The special purpose modular connector plug as recited in claim 1, wherein the housing defines an aperture proximate the second ends of the second set of contacts.

7. The special purpose modular connector plug as recited in claim 1, wherein the means for removably fastening comprises a locking tab formed on the bottom side of the housing diverging therefrom proximate the first end.

8. The special purpose modular connector plug as recited in claim 1, further comprising a third set of contacts disposed in a third plane, the third plane being the second side of the housing, the second side including an inner wall and an outer wall, the third set of contacts comprising a plurality of contacts disposed in parallel and vertical alignment with each other within the third plane.

9. The special purpose modular connector plug as recited in claim 8, wherein the third plane is the second side of the housing, the second side includes an inner wall and an outer wall, and a third set of contacts comprising a plurality of contacts disposed in parallel alignment and staggered vertically with respect to each other within the third plane.

10. The special purpose modular connector plug as recited in claim 1, the first extending arm member having a top side, a bottom side, a first side, a second side and an outer side, the first extending arm member housing the second set of contacts.

11. A special purpose modular connector plug as recited in claim 10, wherein the first extending arm member is integral with the first end of the housing and extends forward therefrom, the second set of contacts being exposed through apertures formed in the first side and top side of the first extending arm member.

12. The special purpose modular connector plug as recited in claim 10 wherein the first extending arm member is integral with the first side of the housing and extends outward therefrom, the second set of contacts being exposed through apertures formed in the first side and outer side of the first extending arm member.

13. The special purpose modular connector plug as recited in claim 10, further comprising a second extending arm member, the second extending arm member being integral with the housing and extending outward therefrom, the second extending arm member having a top side, a bottom side, a first side, a second side and an outer side, the second extending arm member housing the third set of contacts.

14. The special purpose modular connector plug as recited in claim 13, wherein the second extending arm member is integral with the first end of the housing and extends forward therefrom, the second set of contacts being exposed through apertures formed in the first side and top side of the second extending arm member, the apertures being slots disposed in parallel vertical alignment with the slots of the first extending arm member.

15. The special purpose modular connector plug as recited in claim 13, wherein the second extending arm member is integral with the second side of the housing and extends outward therefrom, the second set of contacts being exposed through apertures formed in the first side and outer side of the second extending arm member, the apertures being slots disposed in parallel horizontal alignment with the slots of the first extending arm member.

16. The special purpose modular connector plug of claim 1, further comprising a resistor, the resistor coupled between the second set of contacts.

17. A special purpose modular connector plug for coupling with a female receptacle comprising:

a housing having a central body with a first end, a second end, a first side, a second side, a top side and a bottom side;

a first set of contacts, each contact having a first end and a second end, the first ends of the first set of contacts disposed along a first plane proximate the first end of the housing, the second ends of the first set of contacts proximate the second end of the housing for the transmission of electronic signals over the first set of contacts;

a second set of contacts, each contact having a first end and a second end, the first ends of the second set of contacts disposed along a second plane that is perpendicular to the first plane, the second ends of the second set of contacts for being accessible for the transmission of electronic signals over the second set of contacts; and means for removably fastening the connector in mating disposition with the female receptacle.

18. The special purpose modular connector plug as recited in claim 17, wherein the first plane is the first end of the housing and the second plane is the first side of the housing, the first side of the housing having an inner wall and an outer wall.

19. The special purpose modular connector plug as recited in claim 18 wherein the first end of the second set of contacts is disposed within the housing adjacent the inner wall, and the second set of contacts comprises a plurality of contacts disposed in parallel and vertical alignment with each other within the second plane.

20. The special purpose modular connector plug as recited in claim 18, wherein the first end of the second set of contacts is disposed within the housing adjacent the inner wall, and the second set of contacts comprises a plurality of contacts disposed in parallel alignment and staggered vertically with respect to each other within the second plane.

21. In electrical circuits comprising a modular male connector plug and a modular female receptacle jack, an improved male connector plug comprising:

a generally rectangular housing having a first end, a second end, a first side, a second side, a longitudinal axis, a top side and a bottom side, the housing including a plurality of electrically conductive contacts disposed within;

a first set of conductive contacts disposed in a first plane at the first end of the housing each contact having a first end and a second end;

a second set of conductive contacts disposed in a second plane at the first side of the housing, the first side of the housing having an inner wall and an outer wall, the second set of contacts being disposed adjacent the inner wall, each contact having a first end and a second end; and a locking tab for securely fastening the male connector with the female receptacle.

22. The improved male connector as recited in claim 21, further comprising a third set of contacts disposed in a third plane, the third plane is the second side of the housing, the second side of the housing having an inner wall and an outer wall, the third set of contacts being disposed adjacent the inner wall.

23. The improved male connector as recited in claim 21, wherein the second plane is a first arm member extending outwardly from the first side of the housing.

24. The improved male connector as recited in claim 22, wherein the third plane is a second arm member extending outwardly from the second side of the housing.

* * * * *